US005771049A

United States Patent [19]

Miura et al.

[11] Patent Number: 5,771,049

[45] Date of Patent: Jun. 23, 1998

[54] FLUID-JET RECORDING APPARATUS AND METHOD IN WHICH FLUID-JET HEAD HEATING IS CONTROLLED

[75] Inventors: Yasushi Miura, Kawasaki; Toshiaki Mabuchi, Tama, both of Japan

[73] Assignee: Canon Kabushiki Kaishi, Tokyo, Japan

[21] Appl. No.: 338,836

[22] Filed: Nov. 14, 1994

[30] Foreign Application Priority Data

Nov. 15, 1993 [JP] Japan ..... 5-285369

[51] Int. Cl.[6] ..... B41J 2/01

[52] U.S. Cl. ..... 347/14; 347/17; 347/60

[58] Field of Search ..... 347/14, 17, 60, 347/186

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 5,276,459 | 1/1994 | Danzuka et al. | 347/33 A |
| 5,302,971 | 4/1994 | Ohba et al. | 347/6 |
| 5,359,358 | 10/1994 | Shimamura et al. | 347/9 |

FOREIGN PATENT DOCUMENTS

| | | | |
|---|---|---|---|
| 54-56847 | 5/1979 | Japan . | |
| 59-123670 | 7/1984 | Japan . | |
| 59-138461 | 8/1984 | Japan . | |
| 60-71260 | 4/1985 | Japan . | |
| 62-53492 | 3/1987 | Japan . | |
| 3-46589 | 7/1991 | Japan . | |
| 4-250055 | 9/1992 | Japan | 347/17 |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

An ink-jet printer for printing an imaging using an ink-jet head has a heater for holding the temperature of the ink-jet head above a predetermined temperature. The temperature of the ink-jet head is held above the predetermined temperature at the time of a recording operation. When the recording operation ends, elapsed time from the end of recording is measured and, when elapsed time attains a predetermined time, current fed to the header is stopped. From this point onward, the temperature of the ink-jet head is held at a temperature below that which prevails at the time of recording until the next recording operation begins.

15 Claims, 7 Drawing Sheets

FIG. 5

| CONTINUOUS NON-PRINTING TIME T(hr) (TEMPERATURE ADJUSTED TO 37°C) | 2 | 4 | 6 | 8 |
|---|---|---|---|---|
| EJECTING STATE | ALL NOZZLES OPERATING | ALL NOZZLES OPERATING | 50 NOZZLES NOT OPERATING | 100 NOZZLES NOT OPERATING |

FIG. 6

| CONTINUOUS NON-PRINTING TIME T(hr) (TEMPERATURE ADJUSTMENT TURNED OFF) | 2 | 4 | 6 | 8 |
|---|---|---|---|---|
| EJECTING STATE | ALL NOZZLES OPERATING | ALL NOZZLES OPERATING | ALL NOZZLES OPERATING | ALL NOZZLES OPERATING |

FIG. 7

| CONTINUOUS QUIESCENT TIME T1(hr) | 2 | 4 | 6 | 8 |
|---|---|---|---|---|
| EJECTING STATE | ALL NOZZLES OPERATING | ALL NOZZLES OPERATING | ALL NOZZLES OPERATING | ALL NOZZLES OPERATING |

FLUID-JET RECORDING APPARATUS AND METHOD IN WHICH FLUID-JET HEAD HEATING IS CONTROLLED

BACKGROUND OF THE INVENTION

This invention relates to an ink-jet recording apparatus which uses an ink-discharge head for discharging ink or other fluid. More particularly, the invention relates to an apparatus for performing prescribed printing on a printing medium such as textiles, leather, paper, cloth, non-woven fabric or OHP paper. The invention is especially effective in a recording apparatus of the type which prints over an extended period of time or continuously on cloth having a printing width of greater than 1 m. Specific examples of application include office equipment such as printers, copiers and facsimile machines, mass-production equipment such as textile printing systems and apparatus in which an object is driven using a jetted fluid.

Ink-jet recording system which perform recording by jetting ink droplets onto a recording medium such as paper or cloth include an arrangement in which a recording head is provided with an electrothermal transducer (a heat-generating element) and the heat-generating element is heated to a temperature greater than a prescribed temperature to induce film boiling in the ink, whereby the volume of the ink is increased to discharge an ink droplet. The printing method is well known as Bubble-jet method. With the ink-jet head according to this arrangement, the recording head is always heated to a temperature above the prescribed temperature in the standby state in order to stabilize the amount of ink discharged and hold the recording density substantially constant.

When a non-printing state continues over an extended period of time, the fact that the recording head is being heated at all times means that evaporation of the water content in the ink from the heat nozzle is accelerated and the ink dye affixes itself to the interior of the nozzle, as a result of which the ink cannot be discharged. In order to solve this problem, consideration has been given to performing a prescribed recovery operation (e.g., ink pressurization, suction, preliminary jetting, wiping by a blade, etc.) in a case where the non-printing state continues in excess of a prescribed period of time.

However, when the recovery operation (ink pressurization, suction, preliminary jetting) is frequently carried out in the example of the prior art described above, ink is consumed wastefully and the total amount of consumption increases. This is a cause of high running cost.

Further, in a case where the wiping operation is performed or a combination of wiping and the above-mentioned recovery operations is carried out, problems related to safety arise in a large-size printing apparatus such as a textile printing apparatus. Specifically, in a large-size apparatus, the head carriage itself is large in size and of great weight. For this reason, a carriage motor having a very high torque is used. Further, in order to maintain the apparatus and clean the same (especially the rails and carriage, etc.), there are cases in which personnel perform these tasks inside the apparatus. If the large head carriage were to be moved suddenly during such activities in order to perform the recovery operation, an accident may occur in which a person is injured.

SUMMARY OF THE INVENTION

Accordingly, an object of the present invention is to provide an ink-jet recording apparatus, as well as a method of controlling the head of the apparatus, a method of controlling the recording apparatus, in which the recording medium is not consumed wastefully and non-discharge of the recording medium is prevented through a safe method.

Another object of the present invention is to provide an ink-jet recording apparatus, as well as a method of controlling the head of the apparatus, a method of controlling the recording apparatus, in which jetting failure of the ink-jet head can be prevented without raising running cost.

Yet another object of the present invention is to provide an ink-jet recording apparatus, as well as a method of controlling the head of the apparatus, a method of controlling the recording apparatus, in which ink-jet recording can be performed without clogging of the ink even if the apparatus is left unused for a long period of time.

A further object of the present invention is to provide an ink-jet recording apparatus, as well as a method of controlling the head of the apparatus, a method of controlling the recording apparatus, in which clogging of the ink-jet head can be prevented without wasting ink by making it unnecessary to perform suctioned draw-up of the ink or preliminary ink discharge for the purpose of preventing clogging.

A further object of the present invention is to provide an ink-jet recording apparatus, as well as a method of controlling the head of the apparatus, a method of controlling the recording apparatus, in which clogging of the ink-jet head can be prevented without moving the ink-jet head to carry out a recovery operation.

A further object of the present invention is to provide an ink-jet recording apparatus, as well as a method of controlling the head of the apparatus, a method of controlling the recording apparatus, in which clogging of the ink-jet head can be prevented by eliminating needless movement of the ink-jet head.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 5 is a diagram showing the relationship between leave and ink jetting state in a case where the system was left unused at a head temperature of 37° C.;

FIG. 6 is a diagram showing the relationship between leave and ink jetting state in a case where the system was left unused at a head temperature of 20° C.;

FIG. 7 is a diagram showing the relationship between leave and ink jetting state in a case where the system was left unused at a head temperature of 20° C. after first being left unused for 2 hours at a temperature of 37° C.;

DESCRIPTION OF THE PREFERRED EMBODIMENTS

Preferred embodiments of the present invention will now be described with reference to the accompanying drawings.

Figure 1:
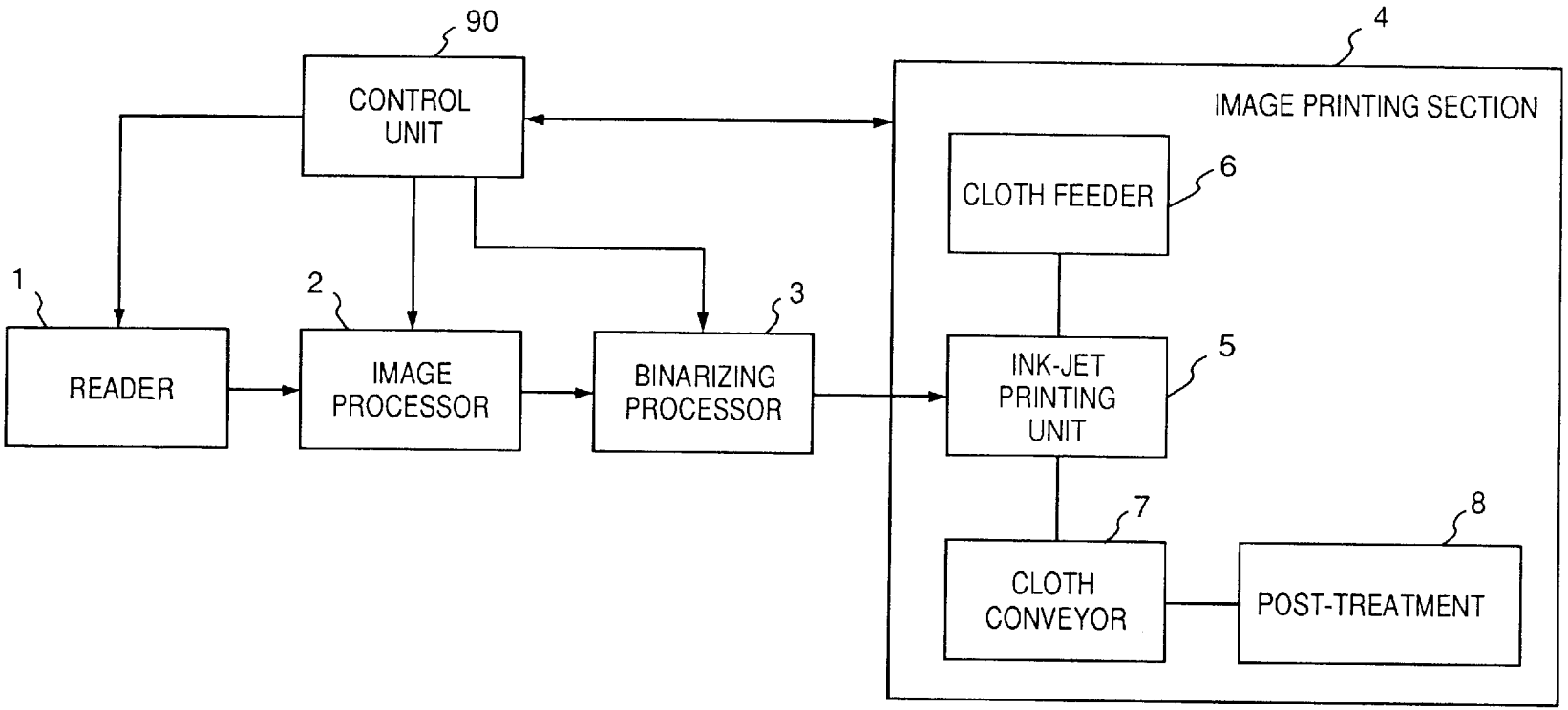
FIG. 1 is a block diagram illustrating the construction of a copying system according to a first embodiment of the present invention.

FIG. 1 is a diagram schematically illustrating the construction of a copying system according to an embodiment to which the present invention is applied.

The copying system includes a reader 1 for reading the image of an original created by a designer or the like, an image processor 2 for processing the read image data of the original, a binarizing processor 3 for binarizing the image data created by the image processor 2, and an image printing section 4 for performing printing on cloth, which is the recording medium, based upon the binarized image data.

The reader 1 uses a CCD image sensor to read the original image and convert it to an electric signal, and outputs the electric signal to the image processor 2. The latter creates recording data from the original-image data applied thereto. The recording data drives an ink-jet recording unit 5 for jetting inks of the four colors magenta (M), cyan (C), yellow (Y) and black (Bk). When the recording data is created, image processing for reproducing the original image by dots of ink, arrangement of colors for deciding color tone, layout change and selection of design size, such as enlargement and reduction, are carried out.

The image printing section 4 includes the aforementioned ink-jet recording unit 5 for jetting ink on the basis of the recording data, a cloth feeder 6 for feeding cloth to the ink-jet recording unit 5, a cloth conveyor 7 provided opposite the ink-jet recording unit 5 to feed the cloth precisely, and a post-treatment unit 8 for applying the cloth which has been recorded on to a post-treatment and storing the cloth after recording. Numeral 90 denotes a control unit for controlling the overall copying system of this embodiment.

The construction of the ink-jet recording unit 5 will now be described. The ink-jet recording unit 5 has an ink-jet head at each of two locations, one above the other, in relation to the direction in which the cloth is conveyed. Since the construction and printing operation are basically the same for each ink-jet head, only the lower will be described with reference to FIGS. 2 and 3.

Figure 2:
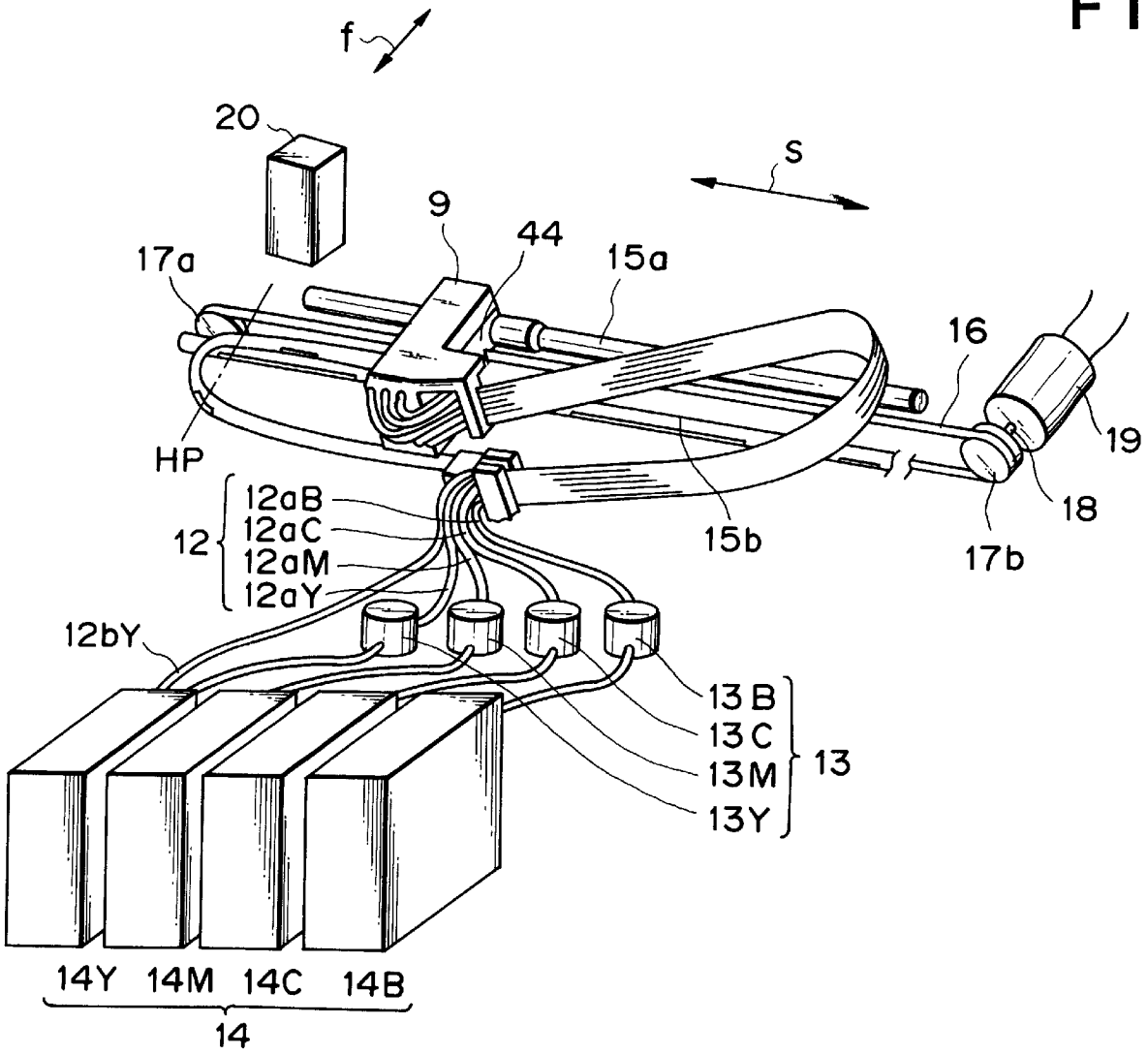
FIG. 2 is a perspective view illustrating the mechanism of an ink-jet recording unit according to this embodiment.

As shown in FIG. 2, the recording unit 5 has an ink-jet head (printing head) 9, two guide rails 15*a,* 15*b,* a head recovery unit 20, a carriage 44 carrying the head 9, an ink supply unit and electrical circuitry (not shown). The ink supply unit, which stores ink and supplies the necessary amount of ink to the printing head 9, has ink tanks 14 and ink pumps 13. The ink supply unit and the printing head 9 are interconnected by ink supply tubing 12. Usually the printing head 9 is supplied with ink automatically by capillary action in an amount equivalent to that jetted from the head. At the time of a head recovery operation, described later, the ink is supplied to the printing head 9 forcibly using the ink pumps 13.

The printing head 9 and the ink supply unit are mounted on the head carriage 44 and an ink carriage (not shown), respectively. The carriage 44 is secured to a belt 16 stretched between two pulleys 17*a,* 17*b.* It is so arranged that the carriage 44 is reciprocated in the directions of the arrows S along the guide rails 15*a,* 15*b* to accompany rotation of the pulley 17*b* attached to a rotary shaft 18 of a carriage motor 19.

The head recovery unit 20 is provided opposite the printing head 9 at a home position HP in order to maintain the stability of the printing head 9. As for the details of operation, the head recovery unit 20 is advanced in the direction of arrow f when it is non-operative. In order to prevent evaporation of ink within the nozzles of the printing head 20, the head recovery unit 20 caps the printing head 9 at the home position (this is referred to as a "capping operation"). Alternatively, in order to discharge air bubbles or contaminants from within the nozzles before the printing of an image begins, it is necessary to pressurize the ink flow passage of the printing head 9 using the ink pumps 13, thereby forcibly discharging the ink from the nozzles (this is referred to as a "pressurized recovery operation"). At this time the head recovery device 20 functions to recover the discharged ink.

Figure 3:
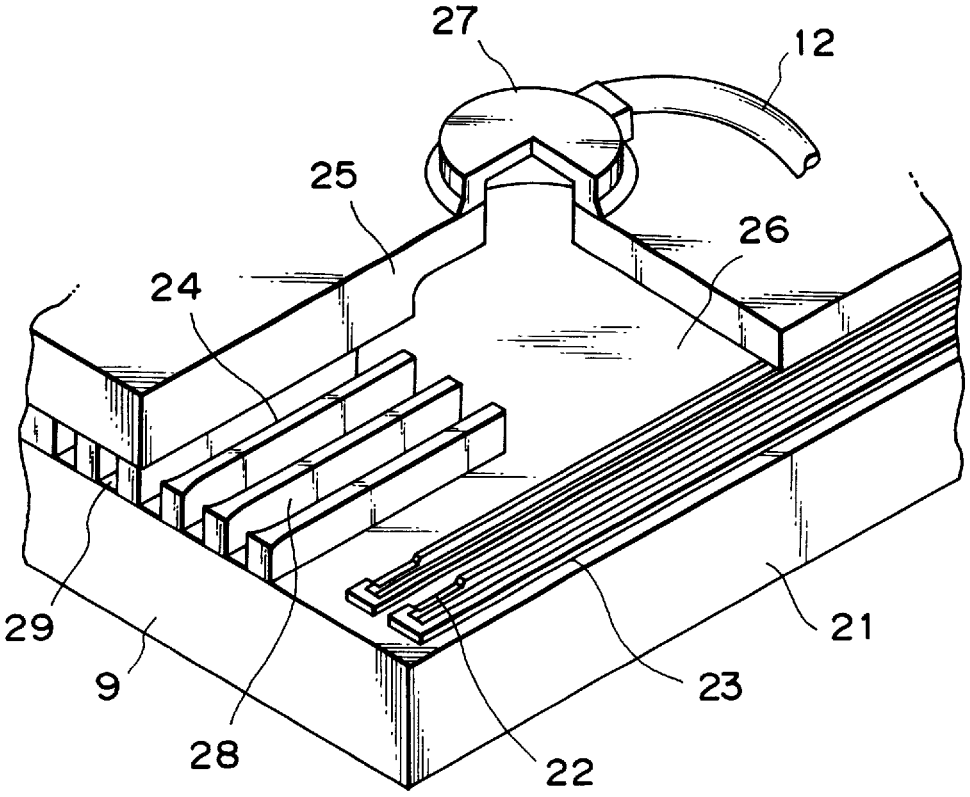
FIG. 3 is a perspective view illustrating the construction of an ink-jet head according to this embodiment.

FIG. 3 is a perspective view for describing the construction of the ink-jet head 9. The head 9, which is the result of a semiconductor manufacturing process that includes etching, vapor deposition, sputtering and the like, includes electrothermal transducers 22, electrodes 23, nozzle walls 24 and a plate 25. These are formed on a substrate 21 by film manufacture.

The printing inks are supplied from the tanks 14 to the interior of a common ink chamber 26 of the printing head 9 through the ink supply tubing 12. Numeral 27 in FIG. 3 denotes a connector for a supply pipe. Ink thus supplied to the interior of the common ink chamber 26 is fed into nozzles 28 by capillary action and is maintained stably by forming a meniscus at the discharge port of the nozzle tip. By passing an electric current through the electrothermal transducer 22, ink on the surface of the transducer is heated to produce a bubbling phenomenon. Owing to the energy of bubbling, ink droplets are ejected from an ejection port 29.

By virtue of this construction, it is possible to manufacture a multiple-nozzle, ink-jet printing head have 128 or 256 nozzles at a high nozzle density of 16 nozzles/mm.

Figure 4:
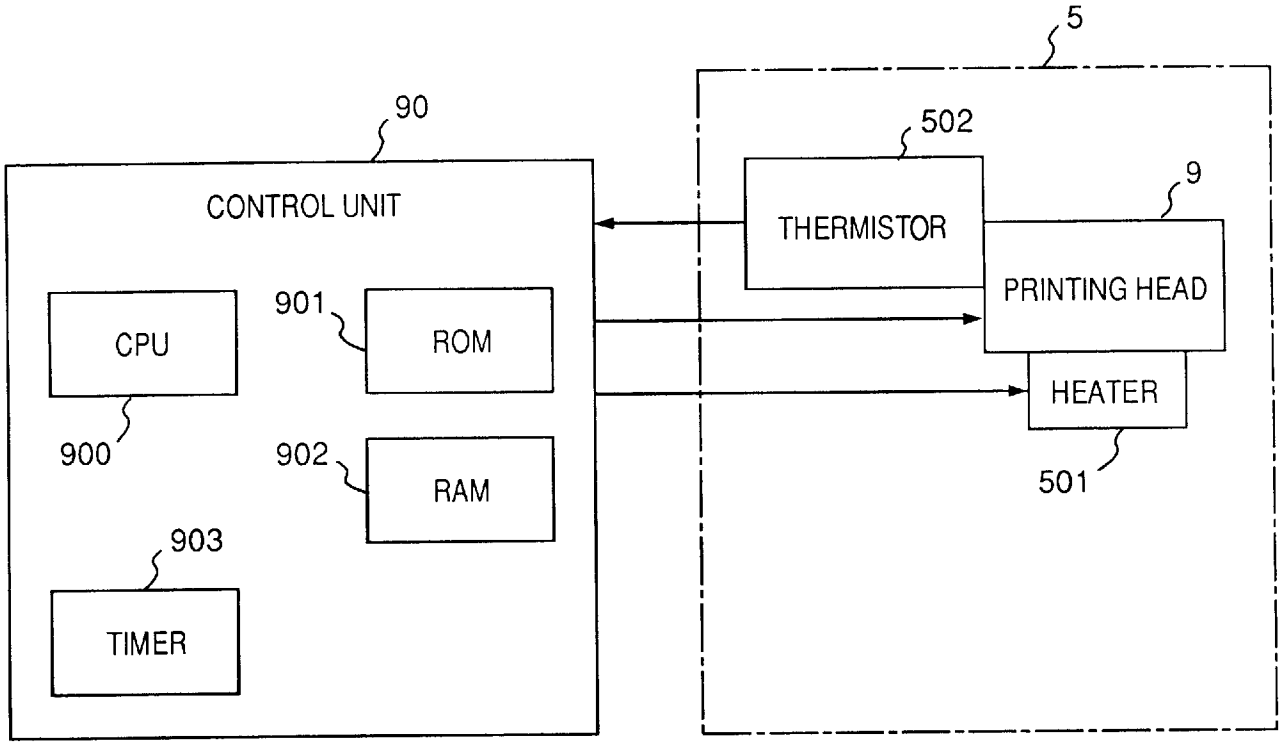
FIG. 4 is a diagram showing the control unit and ink-jet recording unit in the copying system of this embodiment.

FIG. 4 is a block diagram showing the connections between the control unit 90 and ink-jet recording unit 5 of the copying system of this embodiment, as well as the construction of these units. In order to stabilize the amount of ink ejected from each nozzle of the printing head 9, there are provided a head heater 501 for raising the temperature of the printing head 9, and a thermistor 502 for detecting the temperature of the printing head 9. The control unit 90 has a CPU 900 for controlling the overall copying system, a ROM 901 for storing the control program of the CPU 900 as well as various data, and a RAM 902 used as a work area for storing various data when control is executed by the CPU 900. Numeral 903 denotes a timer for measuring elapsed time in response to a command from the CPU 900 and notifying the CPU 900 of the time that has elapsed.

The copying system of this embodiment is effective when used with ink having a high dye density of more than 5%, especially more than 10%, as well as a high degree of water-content evaporation. For example, the copying system is effective when used with the following inks:

| | |
|---|---|
| C.I. Reactive Red 24 | 11.0 parts |
| thiodiglycol | 10.0 parts |
| diethylene glycol | 20.0 parts |
| water | 59.0 parts |
| C.I. Reactive Red 95 | 11.0 parts |
| thiodiglycol | 25.0 parts |
| diethylene glycol | 10.0 parts |
| water | 54.0 parts |

FIGS. 5 and 6 show the results of experiments which indicate ejecting state after the printing head 9 was left standing in the capped state. FIG. 5 illustrates a case in which the printing head 9 was heated to 37° C., and FIG. 6 illustrates the results of ink jetting when heating of the printing head 9 was turned off, the printing head 9 was then left standing at room temperature (20° C.) and heating was subsequently applied by a heater immediately before printing.

As will be appreciated from FIG. 5, if the time left standing at 37° C. is less than 4 hours (hrs) ink will be ejected from all nozzles of the printing head 9. However, if time left standing is 6 hours, the number of nozzles which fail to eject ink is 50. This increases to 100 nozzles if standing time is 8 hours. Thus, it will be understood that it is necessary to hold continuous standing time at 37° C. to less than 4 hours at most.

It will be appreciated from FIG. 6 that when the printing head 9 is left standing at room temperature (20° C.), all nozzles will eject ink even upon elapse of 8 hours.

Figure 8:
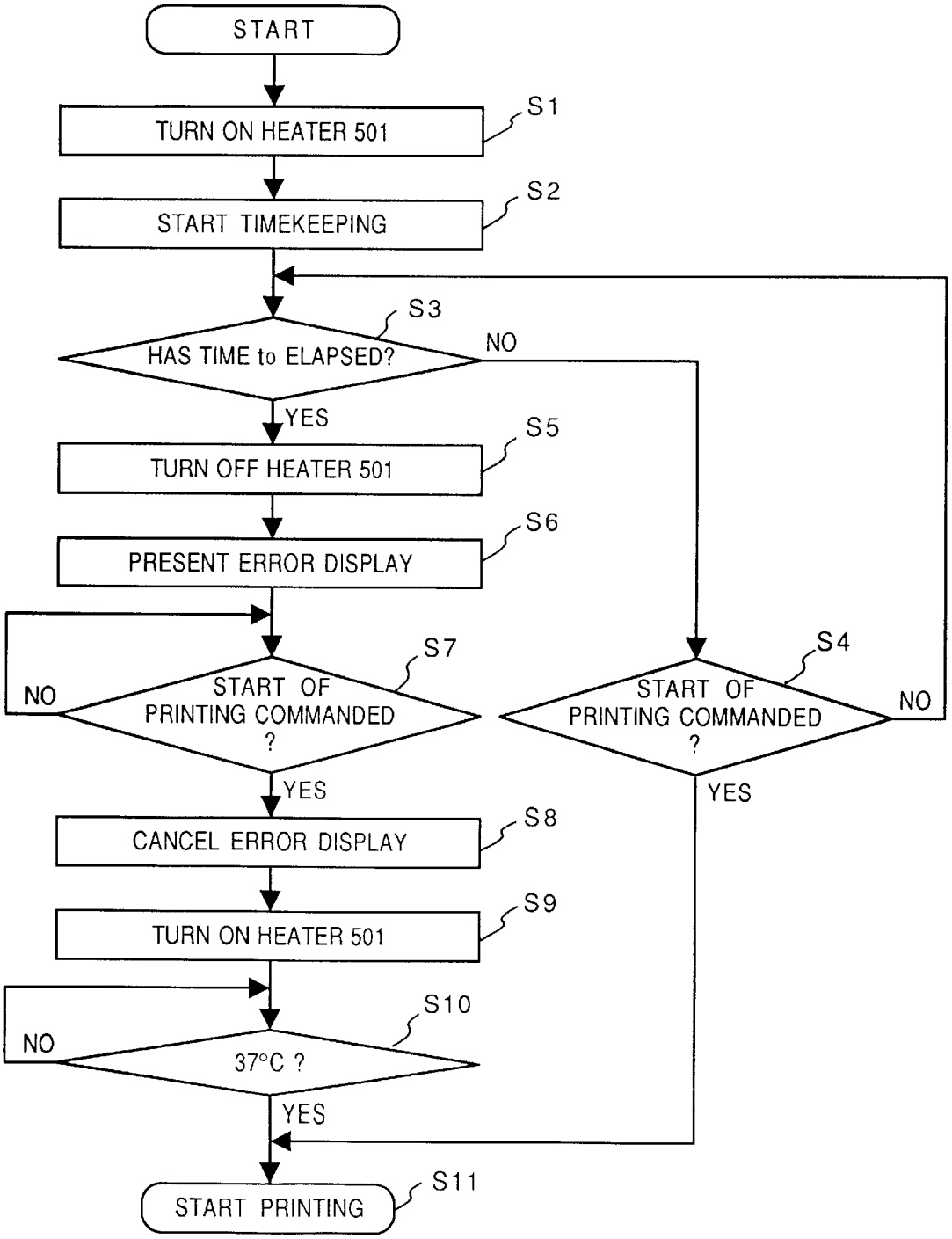
FIG. 8 is a flowchart illustrating processing executed by the control unit of this embodiment.

FIG. 8 is a flowchart illustrating the operation of the ink-jet recording unit 5 according to this embodiment. The control program for executing this processing has been stored in the ROM 901 of the control unit 90 and is executed by the CPU 900.

The processing shown in FIG. 8 starts at the same time that the printing operation ends. Step S1 calls for the heater 501 of the printing head 9 to be turned on. It should be noted that if the heater 50 is on during the printing operation, this step may be eliminated as a matter of course. The program then proceeds to step S2, at which the timer 903 is instructed to start measuring time, and then to step S3, at which it is determined whether a prescribed period of time $t_0$ has elapsed. (By way of example, $t_0$=2 hrs, during which time the temperature of the printing head 9 is held at approximately 37° C.) If the prescribed period of time has not elapsed, then the program proceeds to step S4, at which the system waits for entry of a printer-start command. When there is no input of a printer-start command, the program returns to step S3. When a printer-start command enters, the program proceeds to step S11, at which the printing operation is started.

When it is found at step S3 that printing has not been performed continuously over a period of time which exceeds $t_0$ (2 hrs, for example), the program proceeds to step S5, where the heater 501 is turned off to suspend heating of the printing head 9. This is followed by step S6. Here an error display is presented to inform the operator of the fact that temperature adjustment of the printing head 9 has been terminated. Next, it is determined at step S7 whether the print-start command has entered. If the answer is "YES", then the program proceeds to step S8 to cancel the error display. Next, the head heater 501 is turned on at step S9, after which the system waits at step S10 for the temperature of the printing head 9 to reach approximately 37° C. Whether this temperature has been reached or not is determined on the basis of a signal from the thermistor 502. When this temperature has been attained, the program proceeds to step S11, where the printing operation is started.

FIG. 7 illustrates the results of experimentation in this case.

FIG. 7 is a diagram showing the relationship between quiescent time and ink jetting state in a case where printing was not performed continuously for 2 hrs, during which time the temperature of the printing head 9 was held at about 37° C., after which heating of the printing head 9 was suspended and the apparatus was left continuously in the quiescent state.

It will be understood from FIG. 7 that the temperature of the printing head 9 was held at about 37° C. for 2 hours when printing was not being carried out. Heating by the heater 501 was halted upon elapse of this time. Even after the printing head 9 was left standing for more than 8 hours, raising the temperature of the printing head 9 to about 37° C. prior to the start of printing made it possible to eject ink from all nozzles of the printing head 9 when printing was started. It will be appreciated that this method allows the printing head to fully withstand long periods of continuous disuse.

[Second Embodiment]

In the first embodiment, the heating of the printing head 9 by the heater 501 serving as the heating means is halted completely upon elapse of the prescribed period of time. However, the invention is not limited to this arrangement. For example, it may be so arranged that the temperature of the printing head 9 is held at a low temperature (e.g., 20° C.) after elapse of the prescribed time period.

Figure 9:
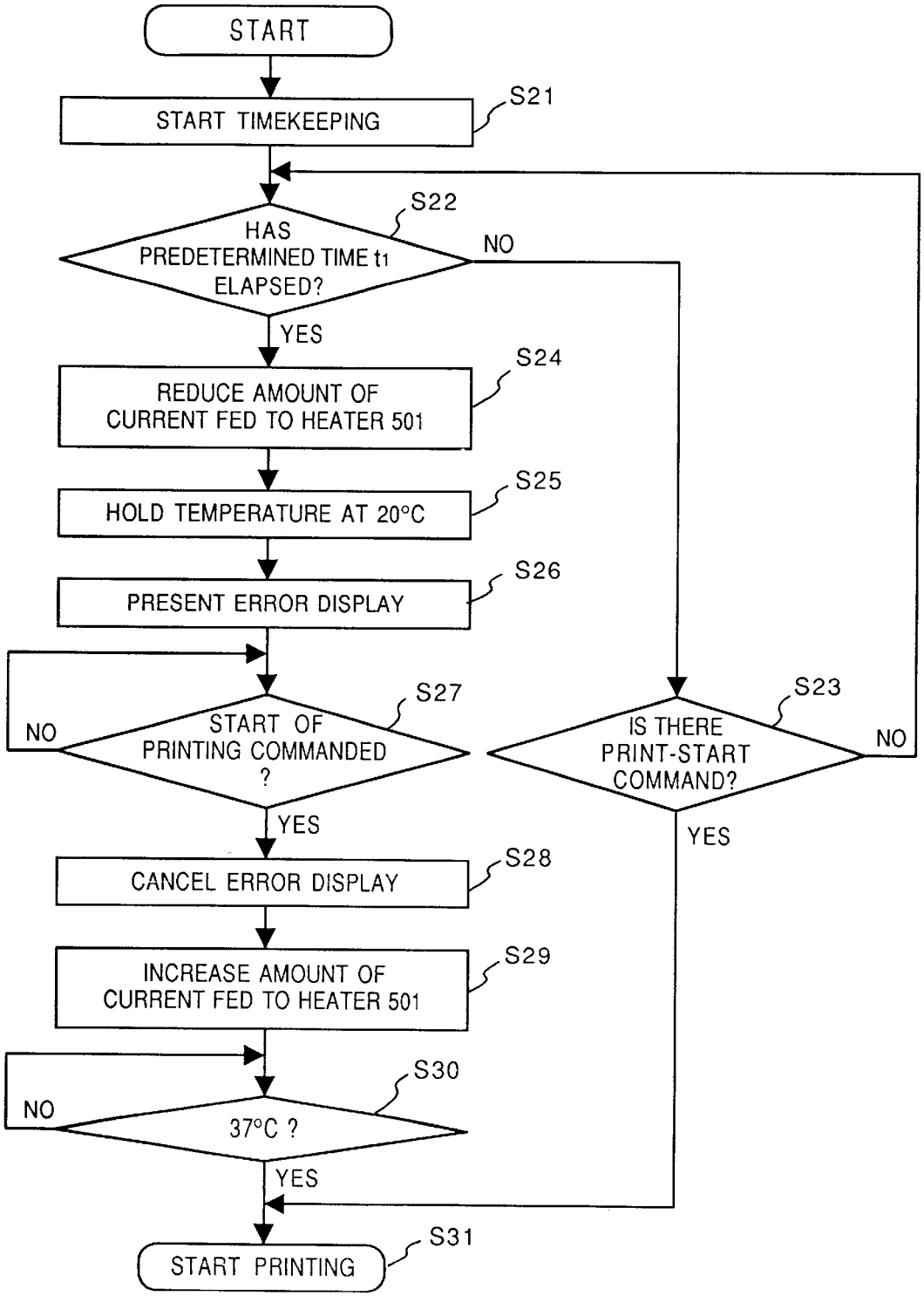
FIG. 9 is a flowchart illustrating processing executed by the control unit of a second embodiment.

FIG. 9 is a flowchart illustrating this processing. In this case also the control program for executing the processing is stored in the ROM 901 and the processing is executed by the CPU 900.

At the end of a printing operation, measurement of time by the timer 903 is started at step S21 and the system waits for elapse of a prescribed time period $t_1$ (e.g., 2 hours) at step S22. If the prescribed period of time has not elapsed, then the program proceeds to step S23, at which the system waits for entry of a printer-start command. When a printer-start command enters, the program proceeds to step S31, at which the printing operation is started.

If the prescribed time $t_1$ elapses at step S22 without entry of the print-start command (during this time the head is being held at a temperature of about 37° C.), then the program proceeds to step S24. Here the amount of current fed to the printing head 9 is reduced or the current is halted to lower the temperature of the printing head 9 to about 20° C. With the head temperature maintained at about 20° C. (step S25), an error display is presented at step S26 to inform the operator of the fact that the head temperature has been lowered. The system then waits for entry of the print-start command.

In the above-described embodiments, the heater 501 is provided for the heating means. However, the present invention is not limited to the embodiments, the electrothermal transducers 22 can be used as the heating means by means of controlling the degree of the temperature of the electrothermal transducers 22.

When the print-start command enters, the program proceeds from step S27 to step S28, at which the error display is canceled in the same manner as at step S8 in FIG. 8. This is followed by step S29, at which the amount of current fed to the heater 501 is increased to raise the head temperature. Then, when the temperature of the head 9 reaches about 37° C. at step S30, the program proceeds to step S31 and the printing operation is started.

By adopting this arrangement, effects similar to those of the first embodiment are obtained even if the environmental temperature is extremely low. Furthermore, since the temperature of the printing head 9 is held at approximately 20° C., only a short period of time is required to raise the head temperature to about 37° C., which is a head temperature at which printing is possible.

The present invention provides particularly outstanding effects in a printer apparatus wherein the ink-jet recording method used by the head is an ink-jet printing method which utilizes thermal energy to form flying ink droplets for the purpose of carrying out printing.

With regard to a typical configuration and operating principle, it is preferred that the foregoing be achieved using the basic techniques disclosed in the specifications of U.S. Pat. No. 4,723,129 and 4,740,796. This scheme is applicable to both so-called on-demand-type and continuous-type apparatus. In the case of the on-demand type, at least one drive signal, which provides a sudden temperature rise that exceeds that for film boiling, is applied, in accordance with printing information, to an electrothermal transducer arranged to correspond to a sheet or fluid passageway holding a fluid (ink). As a result, thermal energy is produced in the electrothermal transducer to bring about film boiling on the thermal working surface of the printing head. Accordingly, air bubbles can be formed in the fluid (ink) in one-to-one correspondence with the drive signals. Owing to growth and contraction of the air bubbles, the fluid (ink) is ejected via the ejection port so as to form at least one droplet. If the drive signal has the form of a pulse, growth and contraction of the air bubbles can be made to take place rapidly and in appropriate fashion. This is preferred since it will be possible to achieve fluid (ink) jetting having excellent response.

Signals described in the specifications of U.S. Pat. Nos. 4,463,359 and 4,345,262 are suitable as drive pulses having this pulse shape. It should be noted that even better recording can be performed by employing the conditions described in the specification of U.S. Pat. No. 4,313,124, which discloses an invention relating to the rate of increase in the temperature of the above-mentioned thermal working surface.

In addition to the combination of the ejection port, fluid passageway and electrothermal transducer (in which the fluid passageway is linear or right-angled) disclosed as the construction of the printing head in each of the above-mentioned specifications, the present invention covers also an arrangement using the art described in the specifications of U.S. Pat. Nos. 4,558,333 and 4,459,600, which disclose elements disposed in an area in which the thermal working portion is curved. Further, it is possible to adopt an arrangement based upon Japanese Patent Application Laid-Open No. 59-123670, which discloses a configuration having a common slit for the jetting portions of a plurality of electrothermal transducers, or Japanese Patent Application Laid-Open No. 59-138461, which discloses a configuration having openings made to correspond to the jetting portions, wherein the openings absorb pressure waves of thermal energy.

As a printing head of the full-line type having a length corresponding to the maximum width of the printing medium capable of being printed on by the recording apparatus, use can be made of an arrangement in which the length is satisfied by a combination of plural printing heads of the kind disclosed in the foregoing specifications, or an arrangement in which printing heads serve as a single integrally formed printing head.

Further, it is possible to use a freely exchangeable tip-type printing head attached to the main body of the apparatus and capable of being electrically connected to the main body of the apparatus and of supplying ink from the main body, or a cartridge-type printing head in which an ink tank is integrally provided on the printing head itself.

The addition of recovery means for the printing head and spare auxiliary means provided as components of the printing apparatus of the invention is desirable since these stabilize the effects of the invention greatly. Specific examples of these means that can be mentioned are capping means for capping the printing head, cleaning means, pressurizing or suction means, and preheating means such as an electrothermal transducer or another heating element or a combination thereof. Implementing a preliminary jetting mode for performing jetting separately of printing also is effective in order to perform stabilized printing.

The printing mode of the printing apparatus is not limited merely to a printing mode for a mainstream color only, such as the color black. The printing head can have a unitary construction or a plurality of printing heads can be combined. It is possible to use an apparatus having at least one printing mode for a plurality of different colors or for full-color printing using mixed colors.

Further, ink is described as being the fluid in the embodiment of the invention set forth above. The ink used may be one which solidifies at room temperature or lower, one which softens at room temperature or one which is a liquid at room temperature. Alternatively, in an ink-jet arrangement, generally the ink is temperature-controlled by regulating the temperature of the ink itself within a temperature range of between 30° C. and 70° C. so that the viscosity of the ink will reside in a region that allows stable ejecting of the ink. Therefore, it is permissible to use an ink liquefied when the recording signal is applied.

In order to positively prevent elevated temperature due to thermal energy by using this as the energy for converting the ink from the solid state to the liquid state, or for the purpose of preventing evaporation of the ink, it is permissible to use an ink which solidifies when left standing. In any case, ink which is liquefied for the first time by thermal energy, such as an ink liquefied by application of thermal energy conforming to a printing signal and ejected as a liquid ink, or ink which has already begun to solidify at the moment it reaches the recording medium, can be applied to the present invention. Such inks may be used in a form in which they oppose the electrothermal transducer in a state in which they are held as a liquid or solid in the recesses or through-holes of a porous sheet, as described in Japanese Patent Application Laid-Open Nos. 54-56847 and 60-71260. In the present invention, the most effective method of dealing with these inks is the above-described method of film boiling.

As to the form of the printing apparatus of the present invention, the apparatus may be employed as a copying apparatus in combination with a reader, as set forth above. Further, the printing apparatus may be provided integrally or separately as an image output terminal of an information processing apparatus such as a word processor or computer. Other configurations include a facsimile machine having a transmitting/receiving function, etc.

In accordance with the present invention, as described above, it is possible to prevent non-ejecting of ink without consuming the ink wastefully and, at the same time, through a safe method.

Subsequently, the description will be made of the entire processes of the ink jet textile printing. After the ink jet textile printing process is executed by the use of the above-mentioned ink jet printing apparatus, the textile is dried (including the natural dry). Then, in continuation, the dyestuff on textile fabric is dispersed, and a process is executed to cause the dyestuff to be reactively fixed to the fabric. With this process, it is possible for the printed textile to obtain a sufficient coloring capability and strength because of the dyestuff fixation.

For this dispersion and reactive fixation processes, the conventionally known method can be employed. A steaming method is named, for example. Here, in this case, it may be possible to give an alkali treatment to the textile in advance before the textile printing.

Then, in the post-treatment process, the removal of the non-reactive dyestuff and that of the substances used in the preparatory process are executed. Lastly, the defect correction, ironing finish, and other adjustment and finish processes are conducted to complete the textile printing.

Particularly, the following performatory characteristics are required for the textile suitable for the ink jet textile printing:

(1) Colors should come out on ink in a sufficient density.

(2) Dye fixation factor is high for ink.

(3) Ink must be dried quickly.

(4) The generation of irregular ink spread is limited.

(5) Feeding can be conducted in an excellent condition in an apparatus.

In order to satisfy these requirements, it may be possible to give a preparatory treatment to the textile used for printing as required. In this respect, the textile having an in receptacle layer is disclosed in Japanese Patent Laid-Open Application No. 62-53492, for example. Also, in Japanese Patent Publication No. 3-46589, these are proposed the textile which contains reduction preventive agents or alkaline substances. As an example of such preparatory treatment as this, it is also possible to name a process to allow the textile to contain a substance selected from an alkaline substance, water soluble polymer, synthetic polymer, water soluble metallic salt, or urea and thiourea.

As an alkaline substance, there can be named, for example, hydroxide alkali metals such as sodium hydroxide, potassium hydroxide; mono-, di-, and tori-ethanol amine, and other amines; and carbonate or hydrogen carbonate alkali metallic salt such as sodium carbonate, potassium carbonate, and sodium hydrogen carbonate. Furthermore, there are organic acid metallic salt such as calcium carbonate, barium carbonate or ammonia and ammonia compounds. Also, there can be used the sodium trichloroacetic acid and the like which become an alkaline substance by steaming and hot air treatment. For the alkaline substance which is particularly suitable for the purpose, there are the sodium carbonate and sodium hydrogen carbonate which are used for dye coloring of the reactive dyestuffs.

As a water soluble polymer, there can be named starchy substances such as corn and wheat; cellulose substances such as carboxyl methyl cellulose, methyl cellulose, hydroxyl ethyl cellulose; polysaccharide such as sodium alginic acid, gum arabic, locasweet bean gum, tragacanth gum, guar gum, and tamarind seed; protein substances such as gelatin and casein; and natural water soluble polymer such as tannin and lignin.

Also, as a synthetic polymer, there can be named, for example, polyvinyl alcoholic compounds, polyethylene oxide compounds, acrylic acid water soluble polymer, maleic anhydride water soluble polymer, and the like. Among them, polysaccharide polymer and cellulose polymer should be preferable.

As a water soluble metallic salt, there can be named the pH4 to pH10 compounds which produce typical ionic crystals, namely, halogenoid compounds of alkaline metals or alkaline earth metals, for example. As an typical example of these compounds, NaCl, $Na_2SO_4$, KCl and $CH_3$. COONa and the like can be named for the alkaline metals, for example. Also, $CaCl_2$, $MgCl_2$, and the like can be named for the alkaline earth metals.

Particularly, salt such as Na, K and Ca should be preferable.In the preparatory process, a method is not necessarily confined in order to enable the above-mentioned substances and others to be contained in the textile. Usually, however, a dipping method, padding method, coating method, spraying method, and others can be used.

Moreover, since the printing ink used for the ink jet textile printing merely remains to adhere to the textile when printed, it is preferable to perform a subsequent reactive fixation process (dye fixation process) for the dyestuff to be fixed on the textile. A reactive fixation process such as this can be a method publicly known in the art. There can be named a steaming method, HT steaming method, and thermofixing method, for example. Also, alkaline pad steaming method, alkaline blotch steaming method, alkaline shock method, alkaline cold fixing method, and the like can be named when a textile is used without any alkaline treatment given in advance.

Further, the removal of the non-reactive dyestuff and the substances used in the preparatory process can be conducted by a rinsing method which is publicly known subsequent to the above-mentioned reactive fixation process. In this respect, it is preferable to conduct a conventional fixing treatment together when this rinsing is conducted.

In this respect, the printed textile is cut in desired sizes after the execution of the above-mentioned post process. Then, to the cut off pieces, the final process such as stitching, adhesion, and deposition is executed for the provision of the finished products. Hence, one-pieces, dresses, neckties, swimsuits, aprons, scarves, and the like, and bed covers, sofa covers, handkerchiefs, curtains, book covers, room shoes, tapestries, table clothes, and the like are obtained. The methods to machine stitch the textile to make clothes and other daily needs are disclosed widely in publicly known publications such as "Modern Knitting and Sewing Manual" published by the Textile Journal Inc. or a monthly magazine "Souen" published by Bunnka Shuppan Kyoku, and others.

As many apparently widely different embodiments of the present invention can be made without departing from the spirit and scope thereof, it is to be understood that the invention is not limited to the specific embodiments thereof except as defined in the appended claims.

What is claimed is:

1. A fluid-jet recording apparatus for recording an image by ejecting an ink from a plurality of nozzles of a fluid-jet head, comprising:

heating means for heating the fluid-jet head to adjust a temperature of the fluid-let head;

temperature maintaining means for holding within a predetermined temperature range the temperature of the fluid-jet head; and timekeeping means for measuring an elapsed time from an end of ink ejection by said fluid-jet head;

wherein said temperature maintaining means holds the temperature of the fluid-jet head within the predetermined range after an end of recording by the fluid-jet head, and stops the heating of the fluid-jet head by said heating means when the elapsed time is not less than a predetermined period of time.

2. The apparatus according to claim 1, wherein the heating of the fluid-jet head is resumed by said heating means when a start of recording is commanded.

3. The apparatus according to claim 1, further comprising measuring means for measuring the temperature of the fluid-jet head, wherein said heating means heats the fluid-let head when the temperature measured by said measuring means falls below a predetermined temperature, whereby the fluid-jet head is maintained at the predetermined temperature until a start of the next recording operation.

4. The apparatus according to claim 1, further comprising ink ejecting means for having a plurality of electrothermal transducers and for ejecting ink from the fluid-jet head.

5. The apparatus according to claim 4, wherein said heating means includes some of said plurality of electrothermal transducers.

6. A fluid-jet recording apparatus for recording an image by ejecting an ink from a plurality of nozzles of a fluid-jet head, comprising:

head heating means for heating the fluid-jet head to adjust the temperature of the fluid-jet head;

temperature maintaining means for holding within a predetermined temperature range the temperature of the fluid-jet head; and timekeeping means for measuring an elapsed time from an end of ink ejection by said fluid-jet head;

wherein said temperature maintaining means holds the temperature of the fluid-jet head within a first temperature range after an end of recording by the fluid-jet head, and holds the temperature of the fluid-jet head within a second temperature range, which is lower than the first temperature range, when the elapsed time measured by said timekeeping means is not less than a predetermined period of time.

7. The apparatus according to claim 6, further comprising recording means for performing recording after the temperature of the fluid-jet head is raised to the first temperature range in response to a recording-start command.

8. The apparatus according to claim 6, wherein said temperature maintaining means holds the fluid-jet head substantially at room temperature.

9. The apparatus according to claim 6, further comprising ink ejecting means for having a plurality of electrothermal transducers and for ejecting ink from the fluid-jet head.

10. The apparatus according to claim 9, wherein said head heating means includes some of said plurality of electrothermal transducers.

11. A control method in a fluid-jet recording apparatus for recording an image by ejecting an ink from a plurality of nozzles of a fluid-jet head by heating the ink in the fluid-jet head, comprising the steps of:

holding a temperature of the fluid-jet head in a first temperature range by driving a heater during a predetermined period of time from an end of ink ejection by the fluid-jet head; and holding the temperature of the fluid-jet head in a second temperature range, which is lower than the first temperature range, by driving the heater when the predetermined period of time has elapsed.

12. The method according to claim 11, wherein the temperature of the fluid-jet head is raised to the first temperature range when a recording-start command is entered.

13. The method according to claim 11, wherein said fluid-jet head includes a plurality of electrothermal transducers.

14. A control method in a fluid-jet recording apparatus for recording an image by ejecting an ink from a plurality of nozzles of a fluid-jet head by heating the ink in the fluid-let head, comprising the steps of:

measuring an elapsed time from an end of ink ejection by said fluid-jet head;

heating the fluid-jet head by driving a heater after an end of recording by using the fluid-jet head; and stopping the driving of the heater when the elapsed time is not less than a predetermined period of time.

15. The method according to claim 14, wherein said fluid-jet head includes a plurality of electrothermal transducers.

* * * * *

UNITED STATES PATENT AND TRADEMARK OFFICE

CERTIFICATE OF CORRECTION

PATENT NO. : 5,771,049

DATED : June 23, 1998

INVENTOR(S) : YASUSHI MIURA, ET AL.

It is certified that error appears in the above-identified patent and that said Letters Patent is hereby corrected as shown below:

COLUMN 10

Line 42, "fluid-let" should read --fluid-jet--;

Line 60, "fluid-let" should read --fluid-jet--.

COLUMN 12

Line 22, "fluid-let" should read --fluid-jet--.

Signed and Sealed this

Sixteenth Day of February, 1999

*Attest:*

*Acting Commissioner of Patents and Trademarks*

*Attesting Officer*